US006719439B1

(12) United States Patent
Tseng et al.

(10) Patent No.: US 6,719,439 B1
(45) Date of Patent: Apr. 13, 2004

(54) DECORATIVE LAMP SUPPORTING LAYERED PETALS DESIGN

(76) Inventors: Jeou-Nan Tseng, No. 50, Lane 118, Chin-Chu Rd., Hsinchu (TW); Hung-Huei Cheng, 2F, No. 99, Sec. 4, Chungking N. Rd., Taipei (TW)

( * ) Notice: Subject to any disclaimer, the term of this patent is extended or adjusted under 35 U.S.C. 154(b) by 0 days.

(21) Appl. No.: 10/301,107

(22) Filed: Nov. 21, 2002

(51) Int. Cl.[7] ..... H01R 33/00
(52) U.S. Cl. ..... 362/226; 362/122; 362/249
(58) Field of Search ..... 362/226, 249, 362/252, 382, 391, 396, 392; 313/318.1, 318.03, 319.09; 439/616, 617

(56) References Cited

U.S. PATENT DOCUMENTS 5,428,516 A * 6/1995 Harris ..... 362/226
5,816,686 A * 10/1998 Wang et al. ..... 362/226
5,899,555 A * 5/1999 Lin ..... 362/122

* cited by examiner

*Primary Examiner*—Thomas M. Sember
*Assistant Examiner*—John Anthony Ward
(74) *Attorney, Agent, or Firm*—William E. Pelton, Esq.

(57) ABSTRACT

A decorative lamp supporting multiple layered petals design is provided. The decorative lamp comes with a lamp bulb, a receptacle, an inner corolla shell and an outer corolla shell. The stacked corolla structure allows the inner corolla shell to be fitted behind the outer corolla shell, and possibly another corolla shell to be fitted in between the outer and inner corolla shells. The decorative lamp has a retaining apparatus to bind multiple corolla shells onto the receptacle, several locating ribs on the surface of the inner corolla shell to prevent dislocation of the corolla shells, and locating rings on the outer rim of the outer corolla shell to prevent falling out of the lamp from the installation ring. Consequently a decorative lamp with layered petals design can be assembled with a robust structure.

7 Claims, 6 Drawing Sheets

DECORATIVE LAMP SUPPORTING LAYERED PETALS DESIGN

BACKGROUND OF THE INVENTION

1. Field of the Invention

The present invention relates to a decorative lamp supporting layered petals design, in particular to a decorative lamp or Christmas lamp that can be constructed by stacking multiple corolla shells on the receptacle to create a layered petals design for boosting the ornamental lighting atmosphere.

2. Description of Related Arts

Decorative lamps have long been used as decorations during the Christmas seasons and in numerous private celebrations. They are also widely used by businesses in conjunction with their market activities, so as to create the desirable lighting effect on the product advertisement to catch the attention of potential customers. However, there has been few innovations in the line of decorative lamps, and the market is largely saturated by conventional decorative lamps.

Recently, a type of decorative lamp appeared on the market that has discrete petals on the corolla portion. The petals are designed over the surface of a cylindrical tube, and several of these are placed over the lamp bulb like sleeve tubes, each on top of the other, so as to bring on a column of colorful floral lighting under the illumination from the stamen. These decorative lamps with many different configurations have been favored by many consumers. Soon after the first batch, manufacturers made further improvements by making the stamen with a transparent material, so that many more colors can be added to the decorative lamp under illumination.

According to the design of the above-mentioned decorative lamps, since the cylindrical tubes are just inserted with the center hole thereof fitting over the lamp bulb, using the tube itself to hold on to the hub, their overall structure is not very steady in the first place. Furthermore, only a single layer of flower petals can be created around the periphery of the cylindrical tube. Several attempts trying to create multiple petal layers have been unsuccessful, due to the extra weight and stability considerations, and the resultant decorative lamp also lacks the dazzling effect that can be observed in the present invention by creating a layered petals design.

SUMMARY OF THE INVENTION

The main object of the present invention is to provide a decorative lamp supporting layered petals design by stacking multiple corolla shells over the receptacle to create a layered petals design to boost the ornamental lighting atmosphere.

The secondary object of the invention is to provide a suitable retaining apparatus for holding multiple corolla shells in between the outer shell and the receptacle to form a robust assembly.

The decorative lamp supporting multiple layered petals design basically comprises:

a lamp bulb installed on the receptacle; and inner and outer corolla shells engulfing the lamp bulb.

The decorative lamp in accordance with the invention is characterized in that the receptacle has a catch strap protruding from one side with a flexible structure.

The decorative lamp in accordance with the invention is characterized in that the inner corolla shell has a petal ring and a cup at the base, and a vertical stem extending downward from one side of the cup with a hook at the end.

The decorative lamp in accordance with the invention is characterized in that the outer corolla shell has a petal ring with a cup, such that the inner perimeter of the outer corolla shell fits over the outer perimeter of the inner corolla shell.

The decorative lamp in accordance with the invention is characterized in that another corolla shell can be fitted in between the inner and outer corolla shells, and the middle corolla shell also has a petal ring with a cup, such that the middle corolla shell fits over the outer perimeter of the inner corolla shell and under the inner perimeter of the outer corolla shell.

The decorative lamp in accordance with the invention is characterized in that the middle corolla shell has a slot at the rim of the cup allowing the vertical stem of the inner corolla shell to pass through during physical assembly.

The decorative lamp in accordance with the invention is also characterized in that the inner corolla shell has multiple locating ribs on the outer surface of the cup portion, and the outer corolla shell has corresponding offset grooves on the inner surface of the cup portion for locating the inner and outer corolla shells.

The decorative lamp in accordance with the invention is also characterized in that the offset grooves appearing on the inner surface of the outer corolla shell extend downward from the top edge for a certain depth.

The decorative lamp in accordance with the invention is also characterized in that the outer surface of the cup portion of the inner corolla shell has an offset ring near the upper rim for fitting the installation ring on the external fixture.

The features and structure of the present invention will be more clearly understood when taken in conjunction with the accompanying drawings.

DETAILED DESCRIPTION OF THE PREFERRED EMBODIMENT

The present invention, in the context of the first embodiment, will hereinafter be described in reference to the drawings.

Figure 1:
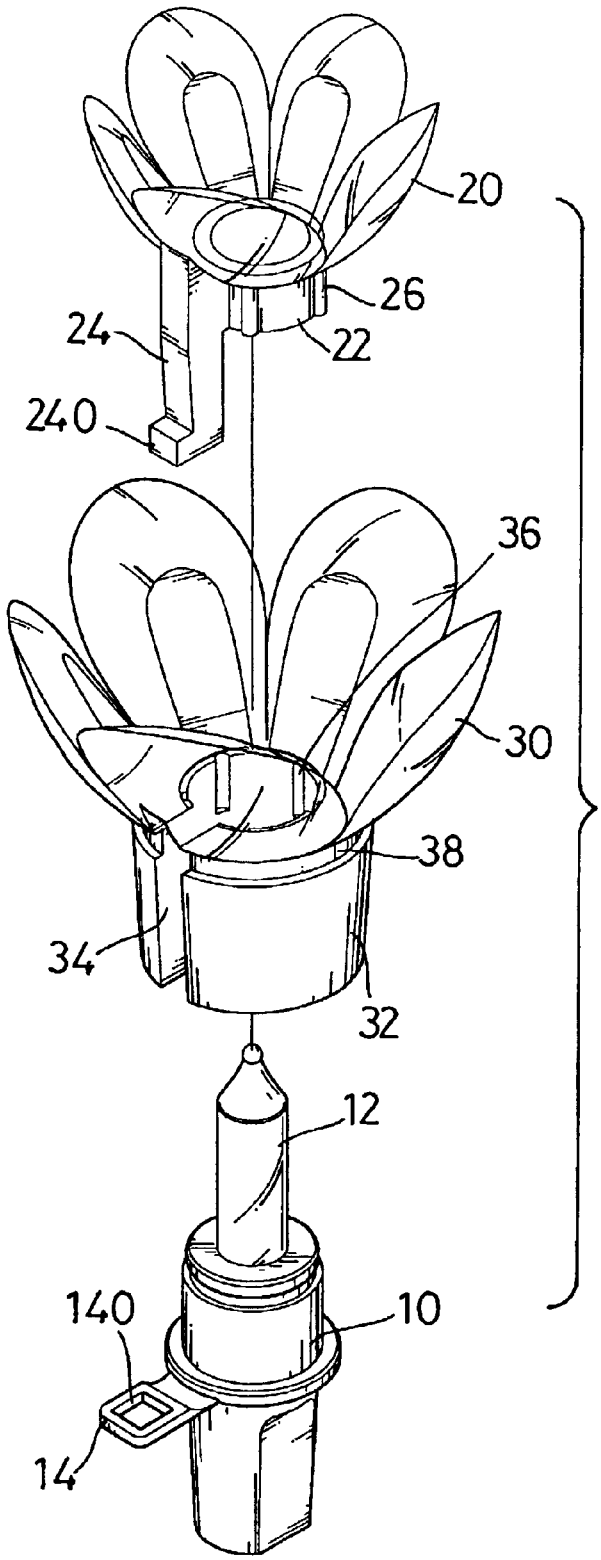
FIG. 1 is an exploded diagram of the first embodiment of the present invention.

With reference to FIG. 1, the structure of the decorative lamp in accordance with the present invention comprises a lamp bulb (12), a receptacle (10), an inner corolla shell (20) and an outer corolla shell (30).

The receptacle (10) has a catch strap (14) protruding from one side, having a flexible structure and a loop (140).

The Inner corolla shell (20) has a petal ring and a cup (22) at the base for placement over the receptacle (10), wherein the cup (22) of the inner corolla shell (20) has a vertical stem (24) extending downward from one side with a hook (240) at the tip for hooking onto the receptacle (10). The inner corolla shell (20) also has a locating rib (26) on the outer surface.

The outer corolla shell (30) has a petal ring and a cup (32), wherein a slot (34) is formed on one side of the cup (32) allowing the vertical stem (24) of the inner corolla shell (20) to pass through, wherein the cup (32) has an offset groove (36) on the inner surface for locating the inner and outer corolla shells (20, 30).

The outer corolla shell (30) has an offset ring (38) on the inner surface and near the upper rim of the cup (32).

Figure 2:
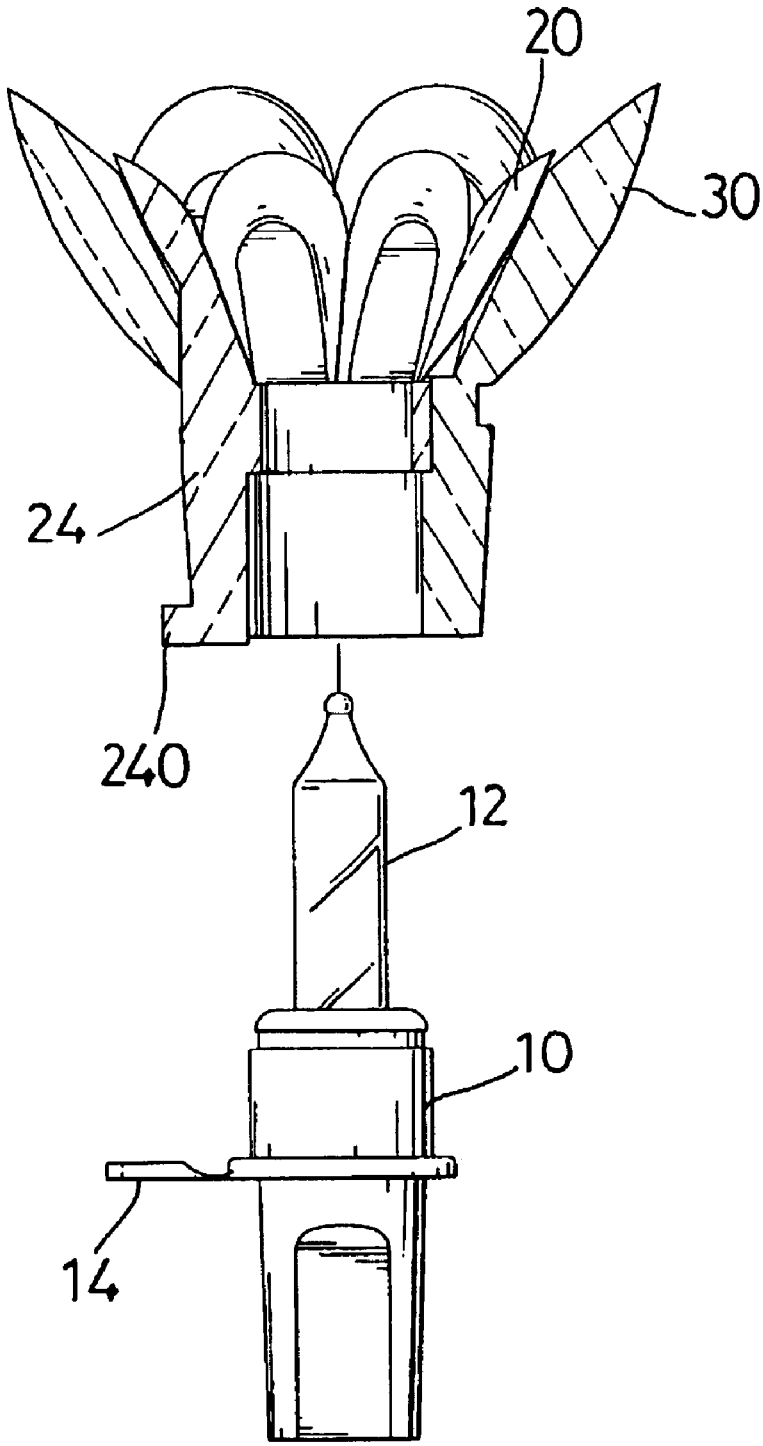
FIG. 2 is a side view of the inner and outer corolla shells assembled for placing over the receptacle.
Figure 3:
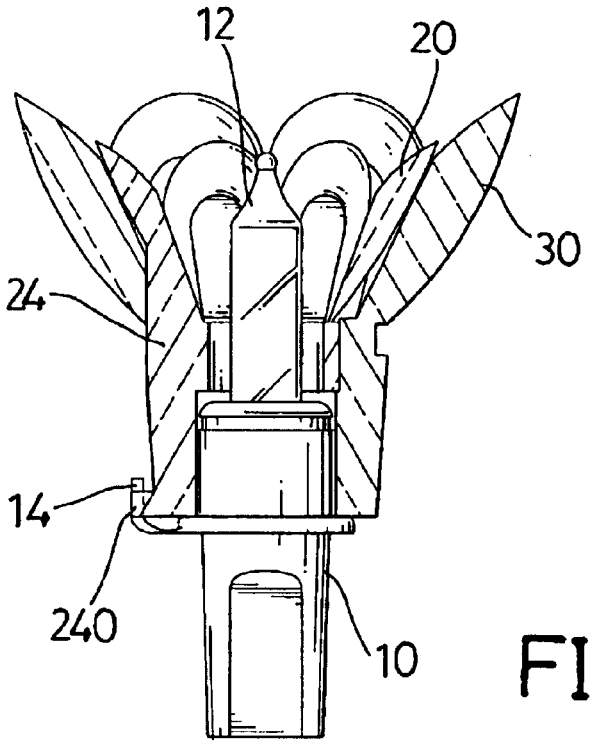
FIG. 3 is a side view and cross-section of the 2-layer decorative lamp.

With reference to FIG. 2, the inner corolla shell (20) can be stacked behind the outer corolla shell (30), allowing the vertical stem, (24) of the inner corolla shell (20) to pass through the slot (34) on the outer corolla shell (30), such that a layered petals design can be created. After joining the inner and outer corolla shells (20, 30), with reference to FIG. 3, the partially completed assembly can then be placed over the receptacle (10), and the vertical stem (24) of the inner corolla shell (20) having a hook (240) at the tip can be inserted into the catch strap (14), thus completing the assembly of the outer shells surrounding the lamp bulb (12).

The retaining apparatus is operated by means of the hook (240) on the vertical stem (24) of the inner corolla shell (20) which is to be inserted through the loop (140) on the catch strap (114) of the receptacle (10) until engagement, thus holding the outer corolla shell (30), the inner corolla shell (20) and the receptacle (10) together with good strength.

Figure 4:
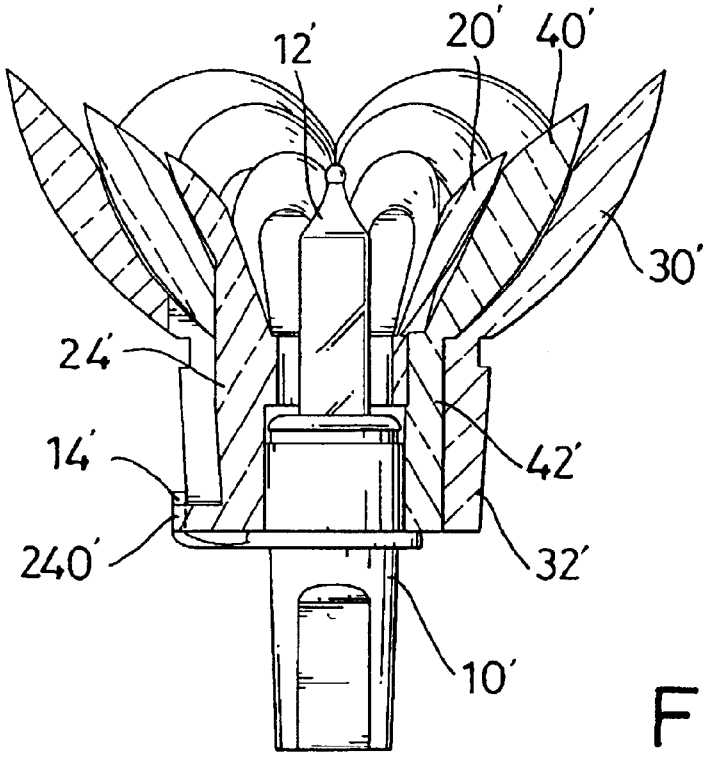
FIG. 4 is a cross-section of the 3-layer decorative lamp.

With reference to FIG. 4, a 3-layer decorative lamp is created in the second embodiment. The configuration of the decorative lamp basically resembles that of the first embodiment shown in FIG. 3, except that a middle corolla shell (40') is added in between the inner and outer corolla shells (20' and 30'). The structure of the middle corolla shell (40') is similar to that of the outer corolla shell (30'), except in physical dimensions. The outer diameter of the middle corolla shell (40') is smaller than the inner diameter of the outer corolla shell (30') so as to permit the middle corolla shell (40') to fit in behind the outer corolla shell (30') during the physical assembly. The outer diameter of the cup (42') of the middle corolla shell (40') also corresponds with the inner diameter of the cup (32') of the outer corolla shell (30'), and the inner diameter of the cup (32') corresponds with the outer diameter of the cup (22') of the inner corolla shell (20'), whereby three corolla shells (20', 30', 40') can be stacked up to form a layered petals design.

The retaining apparatus is basically similar to that of the first embodiment, except that the hook (240') is located deeper down with longer extension on the vertical stem (24'), required for stacking two corolla shells (30', 40') in between the inner corolla shell (20') and the receptacle (10'). In physical assembly, the hook (240') of the vertical stem (24') of the inner corolla shell (20') is to be inserted through the loop hole (140') on the catch strap (14') of the receptacle (10') until engagement, thus holding together the petal assembly (20', 30' and 40') and the receptacle (10) with good strength.

Figure 5:
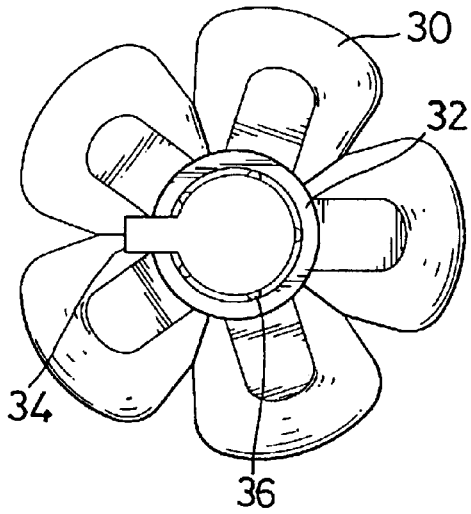
FIG. 5 is a top view of the petal arrangement of the outer corolla shell.
Figure 6:
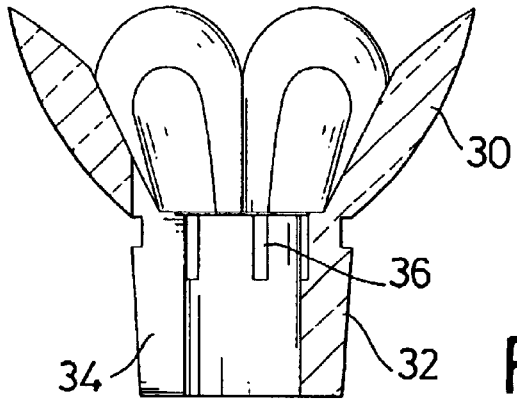
FIG. 6 is a side view and cross-section of the outer corolla shell used in the first embodiment.

With reference to FIG. 5, the outer corolla shell (30) exhibits a petal pattern radiating outward, but it can be changed to form a different pattern if desired. It can be observed that the center of the corolla shell (30) is a cylindrical cup (32) with a slot (34) on one side. With reference to FIG. 6, the detailed structure of the outer corolla shell (30) in the first embodiment reveals multiple offset grooves (36) on the outside of the cup portion (32) extending downward for a certain depth.

Figure 7:
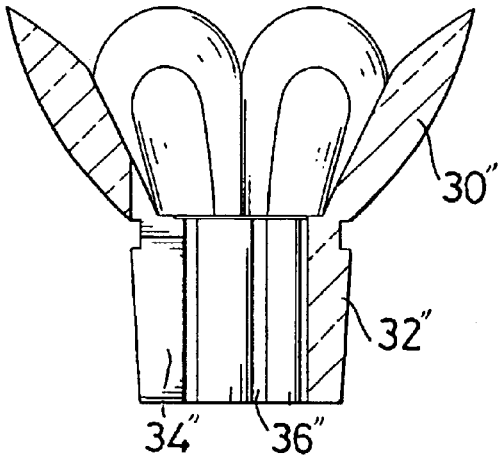
FIG. 7 is a side view and cross-section of the outer corolla shell in the second embodiment.

With reference to FIG. 7, the detailed structural diagram of the outer corolla shell (30") in the second embodiment reveals the offset grooves (36") on the cup (32") extending downward from the top edge to the bottom edge, as opposed to the offset grooves (36) in the first embodiment.

Figure 8:
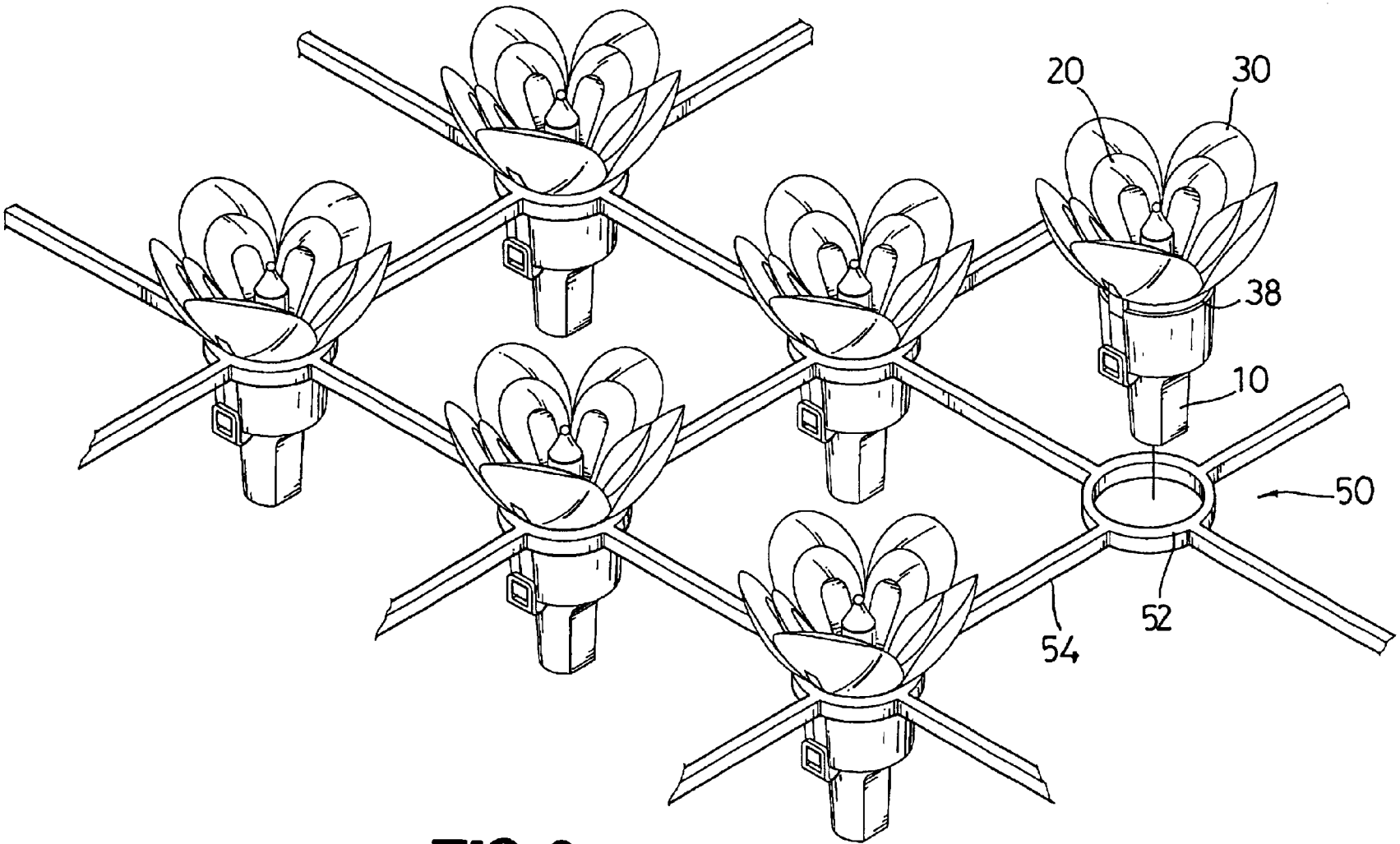
FIG. 8 is a floral arrangement on a grid using the first embodiment.

With reference to FIG. 8, the arrangement of decorative lamps on a grid is implemented with the first embodiment of the invention. The mounting rack has multiple installation rings (52) on the surface, and each installation ring (52) is interconnected by means of connecting bars (54) collectively forming a grid (50). The decorative lamp of the invention is installed through the installation rings (52), such that the offset ring (38) on the outer surface of the outer corolla shell (30) is fitted against the installation ring (52) creating a robust mounting.

Figure 9:
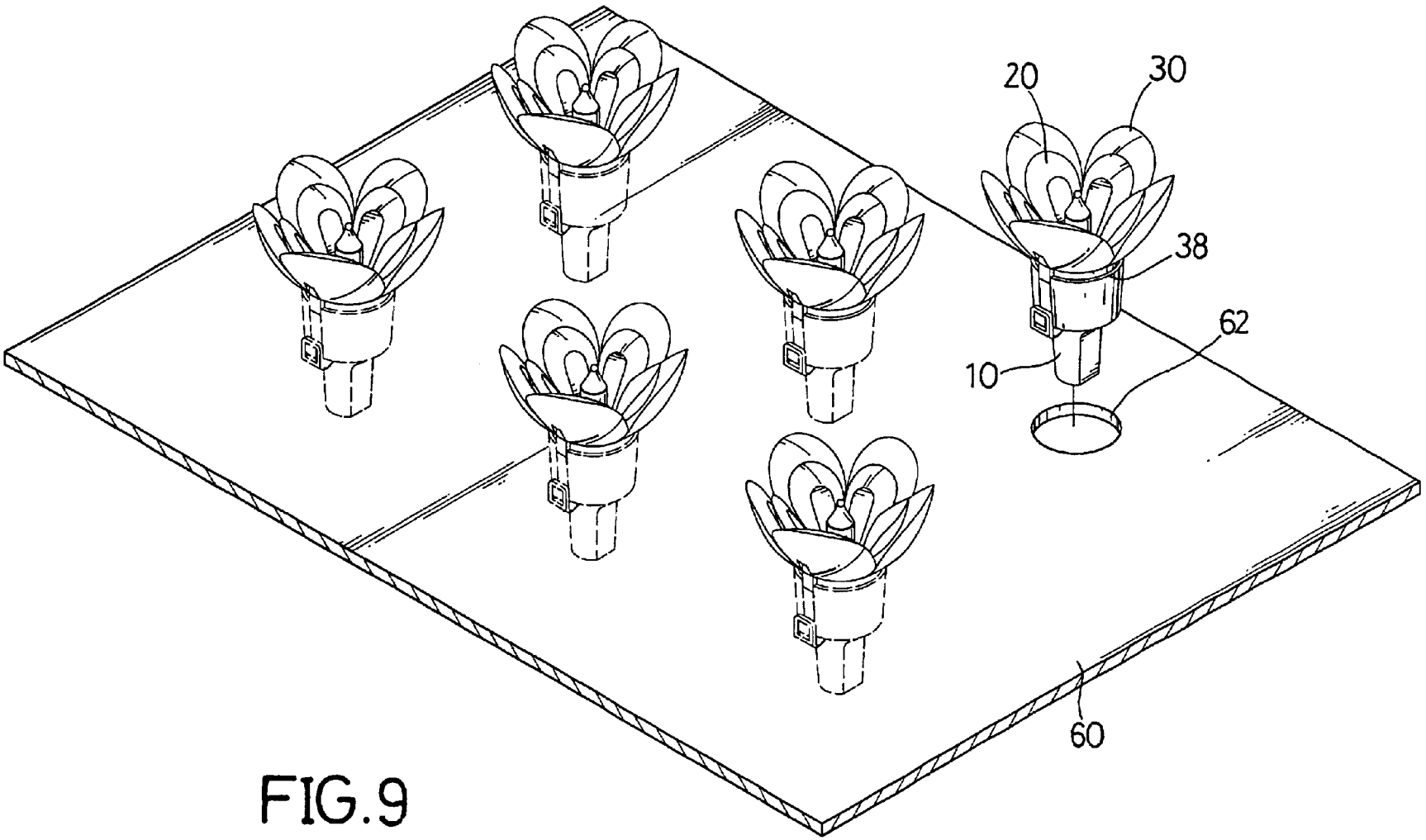
FIG. 9 is another floral arrangement on a card board using the first embodiment.

With reference to FIG. 9, the arrangement of decorative lamps on a piece of card board, also implemented with the first embodiment, which has multiple installation rings (62) on the surface. The decorative lamp of the invention is installed through the installation rings (62) such that the offset ring (38) on the outer surface of the outer corolla shell (30) is fitted against the installation ring (62). The arrangement of the installation rings (62) can be changed to suit different pattern requirements if desired.

The foregoing description of the preferred embodiments of the present invention is intended to be illustrative only and, under no circumstances, should the scope of the present invention be so restricted.

What is claimed is:

1. A decorative lamp supporting multiple layered petals design, comprising:

a lamp bulb; a receptacle, over which the lamp bulb is attached; and an inner and outer corolla shells assembled on the perimeter of the lamp bulb; wherein the receptacle has a catch strap protruding from the lateral side having a flexible structure and a loop;

the inner corolla shell has a petal ring and a cup at a base for placement over the receptacle, wherein the inner corolla shell has a vertical stem extending downward from one side of the cup with a hook at a tip for hooking onto the receptacle; and the outer corolla shell also has a petal ring and a cup, wherein the outer corolla shell has a slot on an upper rim of the cup to allow the vertical stem of the inner corolla shell to pass through during assembling.

2. The decorative lamp supporting multiple layered petals design as claimed in claim 1, wherein the decorative lamp can take on a middle corolla shell to be fitted in between the outer and inner corolla shells, which also has a petal ring and a cup at a base, and a slot down one side of the cup allowing the corolla shell to be fitted in between the outer and inner corolla shells, and the vertical stem of the inner corolla shell to pass through during assembling.

3. The decorative lamp supporting multiple layered petals design as claimed in claim 1, wherein the decorative lamp has a locating rib on the outer surface of the inner corolla shell; and an offset groove on the inner surface of the outer corolla shell for locating these two corolla shells during assembling.

4. The decorative lamp supporting multiple layered petals design as claimed in claim 3, wherein the offset groove on the inner surface of the outer corolla shell extends from atop edge of the cup down to a bottom edge of the cup.

5. The decorative lamp supporting multiple layered petals design as claimed in claim 3, wherein the offset groove on the inner surface of the outer corolla shell extends downward for a certain depth.

6. The decorative lamp supporting multiple layered petals design as claimed in claim 1, wherein the outer corolla shell has an offset ring near the upper rim of the cup.

7. The decorative lamp supporting multiple layered petals design as claimed in claim 2, wherein the outer corolla shell has an offset ring near the upper rim of the cup.

* * * * *